United States Patent [19]

Hofmann et al.

[11] Patent Number: 4,831,861

[45] Date of Patent: May 23, 1989

[54] HYDRAULIC COLD EXTRUSION PRESS

[75] Inventors: Günter Hofmann, Coburg; Herbert Rüger, Schneckenlohe, both of Fed. Rep. of Germany

[73] Assignee: Langenstein & Schemann GmbH, Coburg, Fed. Rep. of Germany

[21] Appl. No.: 155,028

[22] Filed: Feb. 11, 1988

[30] Foreign Application Priority Data

Feb. 26, 1987 [DE] Fed. Rep. of Germany ..... 3706193

[51] Int. Cl.[4] ..... B21J 09/10

[52] U.S. Cl. ..... 72/354; 72/453.07

[58] Field of Search ..... 72/353, 354, 443, 453.06, 72/453.07, 453.08

[56] References Cited

U.S. PATENT DOCUMENTS

| | | | |
|---|---|---|---|
| 3,180,129 | 4/1965 | Riemenschneider et al. | 72/453.06 |
| 4,235,088 | 11/1980 | Kreiskorte | 72/453.07 |
| 4,321,818 | 3/1982 | Bessho | 72/354 |

FOREIGN PATENT DOCUMENTS

| | | | |
|---|---|---|---|
| 30545 | 2/1985 | Japan | 72/354 |
| 76240 | 4/1985 | Japan | 72/353 |

*Primary Examiner*—Lowell A. Larson
*Attorney, Agent, or Firm*—Holman & Stern

[57] ABSTRACT

A cold-extrusion press wherein a platen (4) carries a die part (31) and is capable of being moved towards and away from a stationary table (2) by piston/cylinder devices (5, 6), working piston/cylinder device (7) acts upon extrusion mandrel (11) to exert a deforming pressure, control means (41) activates an adjustable main valve (12, 28) adjustable for different values of travel and speed of the extrusion mandrel (11), platen (4) entrains the extrusion mandrel (11) by spaced stops (22, 23) to an initial position before the extruding stroke, the working piston/cylinder device (7) is subdivided into two working units (8, 9) arranged in tandem and acting upon the same piston rod (10), and only part of the pressure fluid supplied by the working piston/cylinder device (7) is delivered through the main valve (12) to the one working unit (8), whereas the other part of the pressure fluid is delivered to the other working unit (9) without a controlled main valve. Straightforward selection of different values of extrusion travel and speed is afforded by the main valve and the allied control device in a hydraulic press.

8 Claims, 3 Drawing Sheets

HYDRAULIC COLD EXTRUSION PRESS

BACKGROUND OF THE INVENTION

1. Field of the Invention

This invention relates to a hydraulic cold-extrusion press comprising a frame and a pressurized fluid drive where an exchangeable die part is provided on a platen which is capable of being moved towards and away from a stationary table, another exchangeable die part is mounted on a stationary table, the die parts when moved up against each other form a housing-shaped closed die, piston/cylinder means provided on the frame engage the platen for its two-way movement, an ejector capable of being extended and retracted by piston/cylinder means provided on the frame is allied to the table, working piston/cylinder means are provided on the frame to exert pressure for extrusion, and a controlled main valve is provided ahead of the working piston/cylinder means, the piston/cylinder means engaging the platen closing the die without deforming the workpiece contained in it and keeping it closed for the cold extrusion operation, and an exchangeable extrusion mandrel penetrating into the housing-shaped die to effect cold extrusion of the workpiece being acted upon by the working piston/cylinder means.

2. Description of the Prior Art

A prior-art (German Pat. No. 21 41 980) cold-extrusion press is of the multi-step type with respect to the die. The piston/cylinder means engaging the platen also serve as working piston/cylinder means and close the die with the workpieces contained in the die being subjected to cold extrusion in the process. The main valve is opened for the closure of the die and the cold extrusion operation and closed when the die is closed and, consequently, cold extrusion has been completed. A drawback of this prior press is in the fact that the workpiece is formed in several steps. Neither is it possible in this manner to produce workpieces of the type where the material of the slug of metal is required to flow into cavities at right angles to the extrusion pressure.

It is also known in the prior art (German Preliminary Pat. No. 24 19 167) that a split die is closed without deformation of the workpiece contained in it and kept closed for cold extrusion and that an extrusion mandrel penetrating into the housing-shaped die is provided to effect cold extrusion. This arrangement permits precise workpieces to be produced with minimum rework by means of only one cold extrusion operation. Also, the material of the slug will flow into intricate cavities at right angles to the extrusion pressure. This die and the extrusion mandrel are operated by means of a hydraulic press, no details being given about the arrangement of the hydraulic press.

BRIEF SUMMARY OF THE INVENTION

It is an object of the present invention to provide a hydraulic cold-extrusion press of the type initially referred to whereby, on the one hand, workpieces can be produced by means of only one cold-extrusion operation with precision and minimum rework and with the material flowing into intricate cavities at right angles to the extrusion pressure direction and, on the other hand, the means and equipment provided to adapt the press to differently shaped workpieces to be produced are kept straightforward.

In solving this problem, the cold-extrusion press according to the invention is characterized in that control means acting upon an adjustable main valve are capable of being set for different values of extruding travel and extruding speed of the extrusion mandrel, in that the platen engaged by the piston/cylinder means entrains stops spaced an extruding stroke apart to an initial position before the extruding stroke, and in that the working piston/cylinder means are subdivided into two working units arranged in tandem and acting on the same piston rod and only part of the pressure fluid admitted to the working piston means is routed through the main valve to the one working unit, whereas the other part of the pressure fluid is routed to the other working unit without a controlled main valve.

In this manner, cold extrusion by an extrusion mandrel penetrating into the closed die is implemented in a practicable and useful manner in a hydraulic press. A straightforward die is used without additional device and exchanged for different workpieces to be made. Exchanging the extrusion mandrel which is independent of the die is simple, too. Selection of the extrusion travel and the extrusion speed which differ for different workpieces can be accomplished in a simple manner in a hydraulic press by means of the main valve controlling the working piston/cylinder means and the associated control means. The die is stationary on the table. During the unloaded motion, when the stops are entrained by the platen, the main valve has to be brought into a position which corresponds to the closing position of the platen by its actuator according to the speed of the platen and the upper extrusion mandrel.

The movable arrangement of the extrusion mandrel relative to the platen is advantageous although the extrusion mandrel has to follow the closing motion of the platen because the mandrel acts upon the stationary die and the allied working piston/cylinder means can be located at the head of the machine. The mandrel is moved to its working position and back from there by means of the platen which simplifies the operation of the working piston/cylinder means. Since very often unusually great amounts of pressure fluid have to be fed into the working piston/cylinder means for the extruding motion of the mandrel and the main valve cannot pass these great amounts within the desired short period of time, only part of the required pressure fluid is controlled. The uncontrolled part of the pressure fluid will not produce any effect alone and becomes effective only together with the controlled part.

It is especially effective and advantageous if the control means activating the main valve are adjustable for various values of dwell time of the extrusion mandrel after the working stroke. This value, too, can be controlled and adjusted in a simple manner in a hydraulic press. The extruding rate and dwell time are important for the quality of the workpiece to be produced. The variable parameters, viz. extruding travel, extruding rate and dwell time, are taken care of by the hydraulic press which involves a considerable simplification of the equipment required for the selection of different values.

It is also especially effective and advantageous if a further extrusion mandrel is provided to penetrate through the table in a manner permitting two-way movement and if the ejector surrounds this mandrel in the fashion of a tube. This extrusion mandrel need be extended and retracted only over the distance of the working stroke. This provides a space-saving arrangement of the ejector in combination with the extrusion mandrel.

Furthermore, it is especially effective and advantageous if an extrusion mandrel is provided in the table and another extrusion mandrel in the platen and if the control means are arranged for synchronous operation of the two mandrels. The two mandrels work in opposition and there is no need to back up the die against the action of one mandrel. Synchronous operation can be based on synchronous material displacement or synchronous speed. Synchronous control improves the quality of the workpiece to be produced. However, the speeds of the two mandrels are separately adjustable for any desired value so that defined non-synchronous operation of the two mandrels is also possible.

It is especially effective and advantageous if a forming mandrel capable of being extended and retracted by smaller working piston/cylinder means is provided on the frame at right angles to the direction of movement of the extrusion mandrel. This forming mandrel which is smaller compared to the extrusion mandrel provides the workpiece with a hole and calls for only relatively small working piston/cylinder means.

It is especially effective and advantageous in this connection if a forming mandrel is provided on both sides of the die, if the two forming mandrels act in opposite directions and the control means are arranged for synchronous running of the two forming mandrels. As a result of the forming mandrels acting in opposition, the anchorage of the die is relieved of the force applied by the forming mandrel. Provision is also made for the speeds of the two forming mandrels to be adjustable separately for any desired value so that defined non-synchronous operation of the two forming mandrels is possible.

Finally, it is especially effective and advantageous if the pressure fluid drive is formed by a unit comprising a pump and an accumulator. This permits especially high extruding rates to be achieved. For instance, a cold extrusion press according to the invention is intended to provide extruding rates of up to 200 m/s. The extruding cycle as a rule is about 0.15 seconds.

BRIEF DESCRIPTION OF THE DRAWINGS

A preferred embodiment of the invention will now be described in detail with reference to the accompanying drawing wherein.

DETAILED DESCRIPTION

Figure 1:
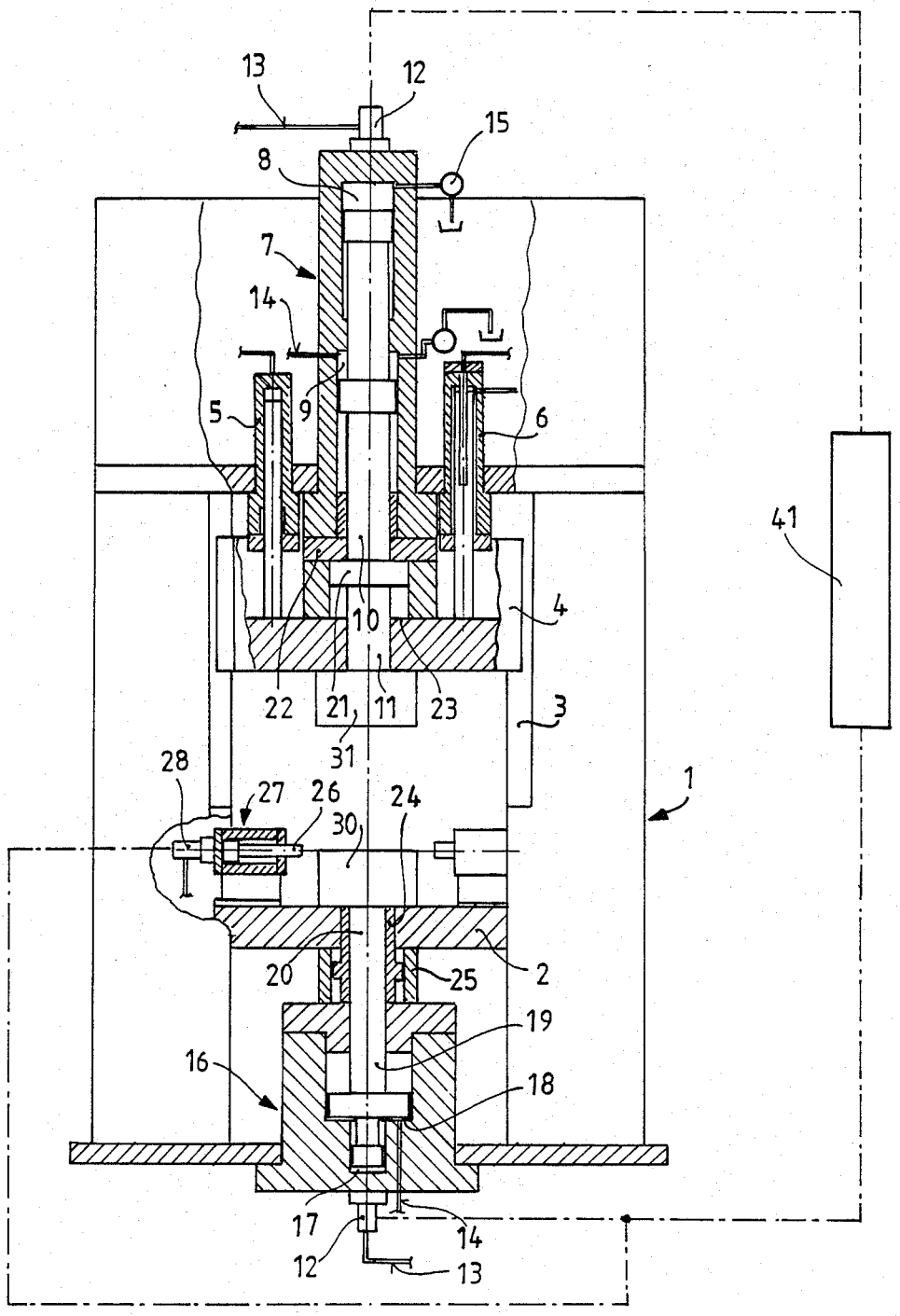
FIG. 1 is a front view of a hydraulic cold-extrusion press according to the invention showing parts schematically and in vertical cross-section.

The hydraulic cold-extrusion press according to the drawing comprises a straight-side frame 1 with a top arch, two lateral uprights and a bed at the bottom. Installed on the bed is a stationary table 2 and a platen 4 is capable of moving up and down along the uprights with guidance provided by guiding means 3. Accurate guidance of the platen is important. The platen can be moved up and down by two piston/cylinder means 5 and two piston/cylinder means 6 which are attached to the top arch of the frame 1. The piston/cylinder means 5 only serve to move the platen 4 downwards and to hold it in a clamping position. The two piston/cylinder means 6, on the one hand, serve to move the platen 4 downwards and to hold it in a clamping position and, on the other hand, also to move the platen back or upwards.

For the return motion, these piston/cylinder means 6 have pressure fluid admitted at the center through a telescopic rod. The four piston/cylinder means 5, 6 cause the platen 4 to be moved into the clamping position without any skewing.

Provided centrally on the upper arch there are drive piston/cylinder means 7 which comprise two working units 8, 9 which both act on the same piston rod 10 which at one end carries an extrusion mandrel 11 which projects through the platen 4. In order to move the extrusion mandrel 11 for an extruding stroke, pressure fluid is admitted to the one working unit 8 through a main valve 12 or servo-valve from a branch line 13 and the other working unit 9 is fed with pressure fluid from a branch line 14. As the drive piston/cylinder means 7 move back, the drive units 8, 9 are each discharged via a controlled valve 15 into the tank, the admission of pressure fluid in the case of the pistons of the two drive units 8, 9 being from below.

On the bed, there are also provided working piston/-cylinder means 16 which are also subdivided into two drive units 17, 18 which both act on the same piston rod 19 which carries an extrusion mandrel at one end which projects through the table 2. Hydraulic actuation of the drive piston/cylinder means 16 is similar to the operation of the other drive/piston cylinder means 7. However, the latter means are moved not only for the extruding stroke of the extrusion mandrel 11, but also with the platen 4 for the unloaded motion. For this unloaded motion, the piston rod 10 is formed with a stop 21 at the back of the platen 4 which is capable of moving to and fro between two stops 22, 23 arranged at a distance from each other and fixedly connected to the platen 4.

The piston rod 19 is surrounded by a tube-shaped ejector 24 in a manner providing guidance. This ejector is guided and capable of being slidably extended from and retracted into the table 2 by piston/cylinder means 25 arranged underneath the table 2. Arranged at each upright of the frame 1 at a point relatively close to the table 2 there are two forming mandrels 26, of which only one is shown, and which are capable of being actuated each by smaller working piston/cylinder means 27 which are fed with pressure fluid via a main valve 28. These forming mandrels 26 produce holes in the workpiece to be made and, as a rule, these would be provided in pairs to act in opposition, one, two or more forming mandrels being provided on each side as required.

Figure 2:
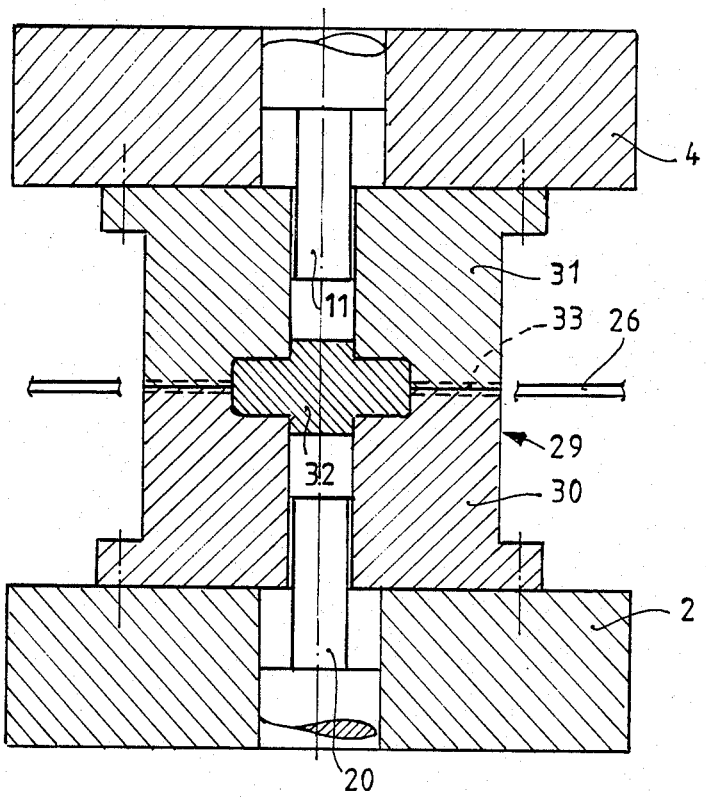
FIG. 2 is an enlarged cross-sectional view of the die of the cold-extrusion press according to FIG. 1.

FIG. 2 shows a die 29 consisting of two die parts 30, 31 of which one 30 is exchangeably bolted to the table 2 while the other 31 is exchangeably attached to the platen 4. The extrusion mandrel guided in the platen 4 projects into a hole in the die 29 and the extrusion mandrel 20 guided in the table 2 similarly projects into a hole in the die, both mandrels being arranged coaxially and acting in opposition. FIG. 2 shows a workpiece 32 made from a slug of material and holes 33 extending in the parting plane between the die parts 30, 31. Through these holes, the forming mandrels act on the workpiece.

The forming mandrels provided opposite each other are arranged coaxially and act in opposition.

Figure 3:
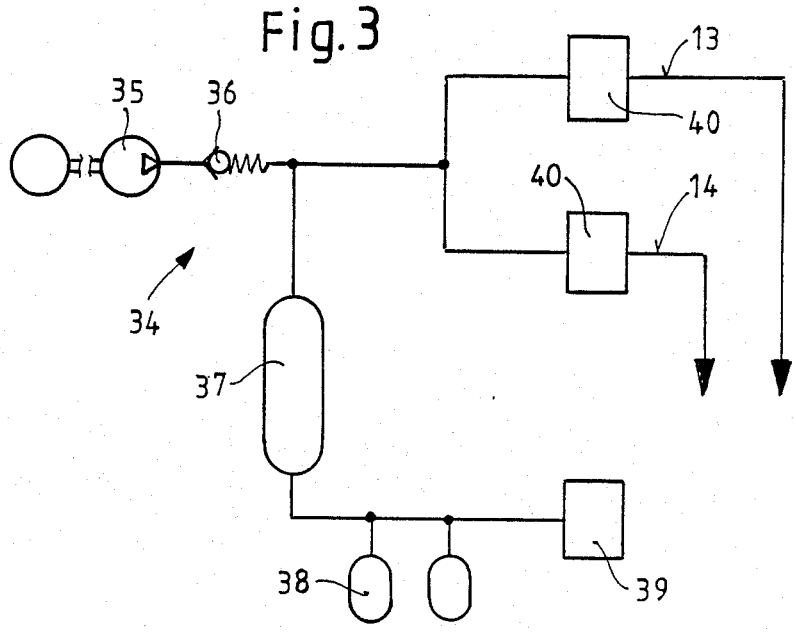
FIG. 3 is a schematic circuit diagram of a pressure fluid drive for the cold-extrusion press according to FIG. 1.

According to FIG. 3, a pressure fluid drive 34 for the drive piston/cylinder means 7, 16, 27 comprises a pump 35 and a motor. The pump 35 is connected via a check-valve 36 to an accumulator 37 to which are also connected gas cylinders 38 and a relief valve 39. The pressure fluid delivered by the pump 35 into the accumulator 37 enters a common pipe which branches out into two branch lines 13, 14 in each of which is provided a supply valve 40 which opens instantly when the accumulator is full.

Figure 4:
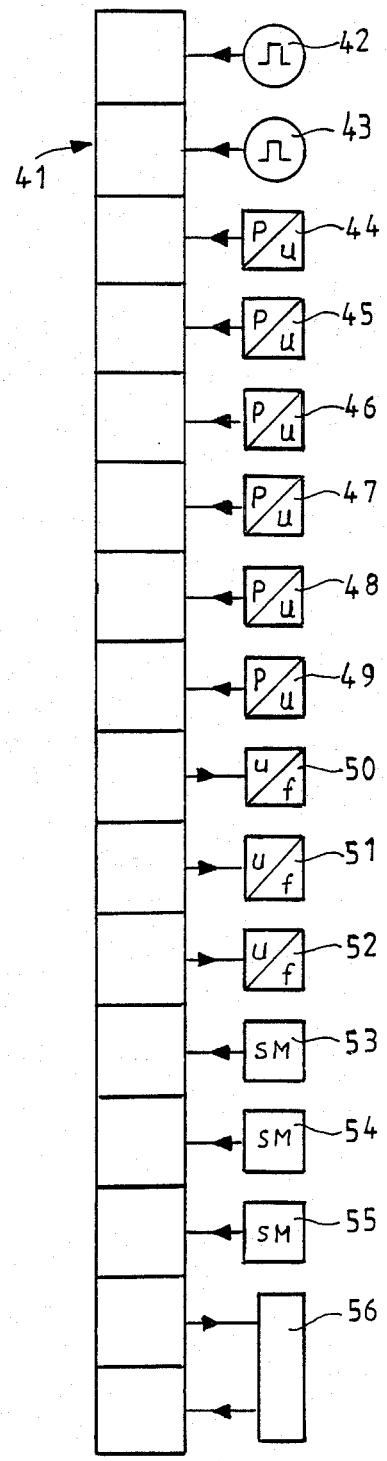
FIG. 4 is a schematic representation of part of the control means of a cold-extrusion press according to FIG. 1.

The control means according to FIG. 4 comprise a computer 41 to which is signalled the momentary position of the upper die part 31 by means of a displacement sensor 42 and to which is signalled the momentary position of the ejector 24 by means of a displacement sensor 43. A pressure sensor 44 measures the pressure for the upper extrusion mandrel 11 on the piston rod side and a pressure sensor 45 measures the pressure for the lower extrusion mandrel 20 on the piston rod side. Pressure sensors 46 and 47 measure the pressure at the ram end each for the upper extrusion mandrel 11 and the lower extrusion mandrel 20. Control of the motions of the extrusion mandrels is effected via a comparison of the rod-side and ram-side pressure values. A pressure sensor 48 permits the closing pressure of the die to be determined. Another presure sensor 49 signals the pressure supplied by the pressure fluid drive according to FIG. 3 to the computer.

For the purpose of controlling the extruding cycle, the output of the computer is applied to the actuator 50 of the main valve or servo-valve of the upper extrusion mandrel and the actuator 51 of the main valve of the lower extrusion mandrel. Similarly, control is provided by means of a valve actuator 52 of the speed of the upper die part during closing and opening. A control element 53 is provided for each of the four lateral forming mandrels to translate the motion of the forming mandrel into the closing of the allied main valve. Also provided is an input device 56 to select the desired mode of operation by means of which the computer can be set, for example, for different values of travel, speed and dwell of the extrusion mandrels and forming mandrels.

We claim:

1. Hydraulic cold extrusion press comprising:

a frame;

a stationary table mounted on said frame;

a first replaceable die part mounted on said table;

a platen movably supported on said frame for movement toward and from said table;

a second replaceable die part mounted on said platen for movement therewith into engagement with said first die part in a closed position and out of engagement with said first die part in an open position;

said die parts having cooperating shapes so that when in said closed position said die parts form a die having an opening therein for receiving a workpiece with no deforming thereof;

first piston and cylinder means mounted on said frame and connected to said piston for moving said platen and said second die part therewith between said open and closed positions;

second working piston and cylinder means having a cylinder means mounted on said frame and a unitary piston movable toward and away from said die to perform an extruding stroke, said second piston and cylinder means comprising first and second separate working units in tandem superposed on said unitary piston;

an extrusion mandrel supported on said unitary piston for movement therewith and extending in said platen for movement in said die opening into engagement with the workpiece for extruding the workpiece during the extruding stroke of said unitary piston;

two stop members in spaced relationship in said platen;

stop means on said unitary piston cooperating and engageable with said stop member for controlling the limits of travel of said unitary piston relative to said platen;

said stop member and stop means positioning said extrusion mandrel into a starting position upon movement of said platen and second die part into said closed position;

fluid flow conduits connecting said first and second separate working units with a source of pressurized hydraulic fluid for operating said unitary piston;

controlled main valve means operatively associated with said second piston and cylinder means and connected to said fluid flow conduit leading to said first working unit for controlling hydraulic fluid flow to said first working unit;

actuator means operatively connected to said controlled main valve means for adjusting said controlled main valve means, part of the pressurized hydraulic fluid being fed to said controlled main valve means and part being fed to said second working unit;

a control device operatively connected to said actuator means for operating said actuator means in response to operating parameters of the press for controlling the extruding stroke and speed of said extrusion mandrel;

ejector means operatively associated with said table for ejecting the workpiece; and third piston and cylinder means mounted on said frame and connected to said ejector means for operating said ejector;

said first piston and cylinder means operating to maintain said die in said closed position during the extruding stroke of said extrusion mandrel.

2. Hydraulic cold extrusion press as claimed in claim 1 wherein:

said control device for operating said actuator means for said main valve means is adjustable to control different dwell times for said extrusion mandrel after the extruding stroke.

3. Hydraulic cold extrusion press as claimed in claim 1 and further comprising:

a second extrusion mandrel penetrating said table and reciprocably movable therein for movement in said die opening into engagement with the workpiece; and a fourth piston and cylinder means mounted on said frame and operatively connected to said second extrusion mandrel for reciprocating said second extrusion mandrel to produce a second extruding stroke thereby;

said ejection means being tubular and surrounding said second extrusion mandrel.

4. Hydraulic cold extrusion press as claimed in claim 3 wherein:

said control device further comprises means for operating said actuating means and said fourth piston and cylinder means synchronously to produce synchronous operation of the extrusion strokes of said extrusion mandrels.

5. Hydraulic cold extrusion press as claimed in claim 1 and further comprising:

at least one forming mandrel mounted on said frame for reciprocating movement in said die substantially perpendicular to the direction of movement of said extrusion mandrel and engageable with the workpiece for forming thereof; and fifth piston and cylinder means operatively connected to said the pressurized hydraulic fluid source and to said at least one forming mandrel for reciprocating said at least one forming mandrel;

said control device controlling operation of said fifth piston and cylinder means.

6. Hydraulic cold extrusion press as claimed in claim 5 wherein:

said at least one forming mandrel comprises a forming mandrel at opposite sides of said die operating in opposite directions on the workpiece;

said fifth piston and cylinder means comprises a piston and cylinder means for each forming mandrel; and said control device comprises control means for producing synchronous operation of said forming mandrels.

7. Hydraulic cold extrusion press as claimed in claim 1 and further comprising:

a pressure fluid drive unit comprising a pump and an accumulator.

8. Hydraulic cold extrusion press as claimed in claim 1 wherein:

said first piston and cylinder means comprises four piston and cylinder units, said four piston and cylinder units being adapted for providing guidance for said extrusion mandrel.

* * * * *